US012187483B2

(12) United States Patent
Suzuki et al.

(10) Patent No.: US 12,187,483 B2
(45) Date of Patent: Jan. 7, 2025

(54) DELAMINATION CONTAINER

(71) Applicant: YOSHINO KOGYOSHO CO., LTD., Tokyo (JP)

(72) Inventors: Takanori Suzuki, Tokyo (JP); Seiichi Asaoka, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 17/640,925

(22) PCT Filed: Aug. 11, 2020

(86) PCT No.: PCT/JP2020/030630
§ 371 (c)(1),
(2) Date: Mar. 7, 2022

(87) PCT Pub. No.: WO2021/049236
PCT Pub. Date: Mar. 18, 2021

(65) Prior Publication Data

US 2022/0332458 A1 Oct. 20, 2022

(30) Foreign Application Priority Data

Sep. 13, 2019 (JP) ..... 2019-167595

(51) Int. Cl.
*B65D 1/02* (2006.01)
*B65D 1/46* (2006.01)
*B65D 83/00* (2006.01)

(52) U.S. Cl.
CPC ..... *B65D 1/0215* (2013.01); *B65D 1/0246* (2013.01); *B65D 1/0276* (2013.01);
(Continued)

(58) Field of Classification Search
CPC .. B65D 1/0215; B65D 1/0223; B65D 79/005; B65D 83/0055; B65D 21/08;
(Continued)

(56) References Cited

U.S. PATENT DOCUMENTS 5,971,184 A * 10/1999 Krishnakumar ..... B65D 23/102 220/675
8,118,183 B2 * 2/2012 Iwahashi ..... B65D 83/0055 215/385

(Continued)

FOREIGN PATENT DOCUMENTS

JP 2001-278234 A 10/2001
JP 2001-315740 A 11/2001

(Continued)

OTHER PUBLICATIONS

Definition of "Circumference", Dictionary.com (Year: 2023).*

(Continued)

*Primary Examiner* — Andrew T Kirsch
(74) *Attorney, Agent, or Firm* — Oliff PLC

(57) ABSTRACT

A container with separable laminated layers includes an outer layer body, an inner layer body separably laminated on an inner surface of the outer layer body and capable of undergoing volume reduction and shape change, and an ambient air inlet continuously extending between the outer layer body and the inner layer body. The container with separable laminated layers has a bottle shape including a tubular mouth, a shoulder continuous with the mouth, a trunk continuous with the shoulder, and a bottom continuous with the trunk. The trunk includes a squeeze area that is continuous with the shoulder via a circumferential step portion or a circumferential rib portion. The step portion or the rib portion is provided with a recess that is concave toward an inner side of the container.

12 Claims, 4 Drawing Sheets

(52) U.S. Cl.
CPC ..... *B65D 1/46* (2013.01); *B65D 83/0055* (2013.01); *B65D 2501/0027* (2013.01); *B65D 2501/0036* (2013.01)

(58) Field of Classification Search
CPC ..... B65D 23/02; B65D 25/14; B65D 25/16; B65D 35/56; B29C 2949/0753
See application file for complete search history.

(56) References Cited

U.S. PATENT DOCUMENTS

| | | | | |
|---|---|---|---|---|
| 8,408,426 | B2 * | 4/2013 | Bakhos | B65D 81/245 222/105 |
| 2015/0298890 | A1 * | 10/2015 | Miyairi | B65D 83/0061 215/12.1 |
| 2016/0185505 | A1 * | 6/2016 | Van Hove | B29B 11/14 222/105 |

FOREIGN PATENT DOCUMENTS

| | | | |
|---|---|---|---|
| JP | 2005-186996 | A | 7/2005 |
| JP | 2017-210279 | A | 11/2017 |
| JP | 2018-039572 | A | 3/2018 |
| JP | 2018-087036 | A | 6/2018 |
| JP | 2018-188183 | A | 11/2018 |
| JP | 2019-018892 | A | 2/2019 |
| JP | 2019-099212 | A | 6/2019 |
| JP | 2019-119478 | A | 7/2019 |

OTHER PUBLICATIONS

Definition of "Circumferential", Dictionary.com (Year: 2023).*
Mar. 15, 2022 International Preliminary Report on Patentability issued in International Patent Application No. PCT/JP2020/030630.
Oct. 13, 2020 International Search Report issued in International Patent Application No. PCT/JP2020/030630.
May 16, 2023 Office Action issued in Japanese Patent Application No. 2019-167595.
May 11, 2023 Office Action issued in Chinese Patent Application No. 202080063167.6.
May 23, 2023 Office Action issued in Canadian Patent Application No. 3,150,128.
Jan. 12, 2024 Office Action issued in Korean Patent Application No. 10-2022-7007312.
Sep. 19, 2023 Search Report issued in European Patent Application No. 20862416.3.
Oct. 10, 2023 Office Action issued in Japanese Patent Application No. 2019-167595.
Aug. 29, 2024 Office Action issued in Canadian Patent Application No. 3,150,128.

* cited by examiner

DELAMINATION CONTAINER

TECHNICAL FIELD

The present disclosure relates to a container with separable laminated layers (which is also referred to as a delamination container).

BACKGROUND

As containers for storing food seasoning such as soy sauce, food such as beverages, cosmetics such as skin lotion, and toiletries such as shampoo, conditioner, or liquid soap as contents, containers with separable laminated layers are known. Such a container with separable laminated layers includes an outer layer body, an inner layer body separably laminated on an inner surface of the outer layer body and capable of undergoing volume reduction and shape change, and an ambient air inlet which extends between the outer layer body and the inner layer body. In the container with separable laminated layers, it is possible to cause the inner layer body to undergo volume reduction and shape change in conjunction with dispensing of the contents, by introducing ambient air between the outer layer body and the inner layer body through the ambient air inlet after the contents is dispensed to the outside. Thus, the contents can be dispensed without being replaced by ambient air. This reduces contact between the contents stored in the inner layer body with ambient air, thereby preventing deterioration and change in quality of the contents.

Examples of containers with separable laminated layers include a squeeze-type container that has a bottle shape including a tubular mouth, a shoulder that is continuous with the mouth, a trunk that is continuous with the shoulder, and a bottom that is continuous with the trunk, wherein the trunk has a flexible and restorable squeeze area, which can be squeezed (pressed) so that the contents stored inside the container are dispensed to the outside through the mouth.

A container with separable laminated layers of such a squeeze-type is conventionally known in which flexibility and restorability in the squeeze area is increased by providing a circumferential step portion or a circumferential rib portion between the shoulder and the squeeze area, so as to increase dispensing operability for the contents in response to a squeeze (for example, Patent Literature 1).

CITATION LIST

Patent Literature

PTL 1: JP 2019-018892 A

SUMMARY

Technical Problem

In the conventional container with separable laminated layers including the circumferential step portion or the circumferential rib portion provided between the shoulder portion and the squeeze area, depending on the material or the like of the container, a step of the step portion may need to be made larger or the rib portion may need to be formed deeper, in order to ensure flexibility and restorability of the squeeze area.

When the step of the step portion is made larger or the rib portion is formed deeper, however, the inner layer body is also configured not to collapse easily in part thereof provided with the step portion or the rib portion. This may cause the problem that the inner layer body is less likely to separate from the outer layer body after dispensing of the contents.

In contrast, when the step of the step portion is made smaller or the rib portion is formed shallower, it is impossible to sufficiently increase flexibility and restorability of the squeeze area, and dispensing operability for the contents cannot be ensured.

It would be helpful to provide a squeeze-type container with separable laminated layers capable of increasing separability of the inner layer body while ensuring dispensing operability for the contents.

Solution to Problem

A container with separable laminated layers according to the present disclosure includes an outer layer body, an inner layer body separably laminated on an inner surface of the outer layer body and capable of undergoing volume reduction and shape change, and an ambient air inlet continuously extending between the outer layer body and the inner layer body, wherein the container with separable laminated layers has a bottle shape including a tubular mouth, a shoulder continuous with the mouth, a trunk continuous with the shoulder, and a bottom continuous with the trunk, the trunk includes a squeeze area that is continuous with the shoulder via a circumferential step portion or a circumferential rib portion, and the step portion or the rib portion is provided with a recess that is concave toward an inner side of the container.

In a preferred embodiment of the present container with separable laminated layers configured as above, the recess is formed in a longitudinal rib shape extending in a direction from the shoulder toward the trunk.

In another preferred embodiment of the present container with separable laminated layers configured as above, the step portion or the rib portion is provided with a plurality of the recesses arranged at intervals in a circumferential direction.

In still another preferred embodiment of the present container with separable laminated layers configured as above, the shoulder is provided with a concave rib that is concave toward the inner side of the container and that extends in a vertical direction, and the recess is arranged below the concave rib so as to align with the concave rib in a circumferential direction.

In still another preferred embodiment of the present container with separable laminated layers configured as above, the step portion has a curved shape that gradually decreases in diameter in a direction from the shoulder toward the squeeze area and that is convex toward an outer side of the container.

In still another preferred embodiment of the present container with separable laminated layers configured as above, the trunk includes a reinforced area that is continuous with a lower end of the squeeze area via a circumferential secondary step portion or a circumferential secondary rib portion.

In still another preferred embodiment of the present container with separable laminated layers configured as above, the trunk includes a reinforced area provided below the squeeze area, and the reinforced area is provided with a peripheral groove extending around an axis, and a pair of upper and lower secondary recesses that are concave toward the inner side of the container and that extend over an outer peripheral surface of the reinforced area and the peripheral groove.

In still another preferred embodiment of the present container with separable laminated layers configured as above, in the reinforced area, a plurality of the peripheral grooves are provided so as to be arranged at intervals in a vertical direction, and a plurality of the pairs of upper and lower secondary recesses are provided with respect to each of the plurality of peripheral grooves.

In still another preferred embodiment of the present container with separable laminated layers configured as above, in the reinforced area, a plurality of the pairs of upper and lower secondary recesses are provided at intervals in a circumferential direction.

In still another preferred embodiment of the present container with separable laminated layers configured as above, each secondary recess in the pair of upper and lower secondary recesses is formed in a longitudinal rib shape extending in a direction from the shoulder toward the bottom.

In still another preferred embodiment of the present container with separable laminated layers configured as above, the peripheral groove includes a bottom wall portion with a convex shape protruding toward an outer side of the container and extending around the axis.

In still another preferred embodiment of the present container with separable laminated layers configured as above, the pair of upper and lower secondary recesses is provided so as to align with the recess in a circumferential direction.

In still another preferred embodiment of the present container with separable laminated layers configured as above, the outer layer body and the inner layer body are made of polyethylene terephthalate.

Advantageous Effect

According to the present disclosure, a squeeze-type container with separable laminated layers capable of increasing separability of the inner layer body while ensuring dispensing operability for the contents can be provided.

DETAILED DESCRIPTION

Hereinafter, a container 1 with separable laminated layers according to an embodiment of the present disclosure will be described in detail with reference to the drawings.

Figure 1:
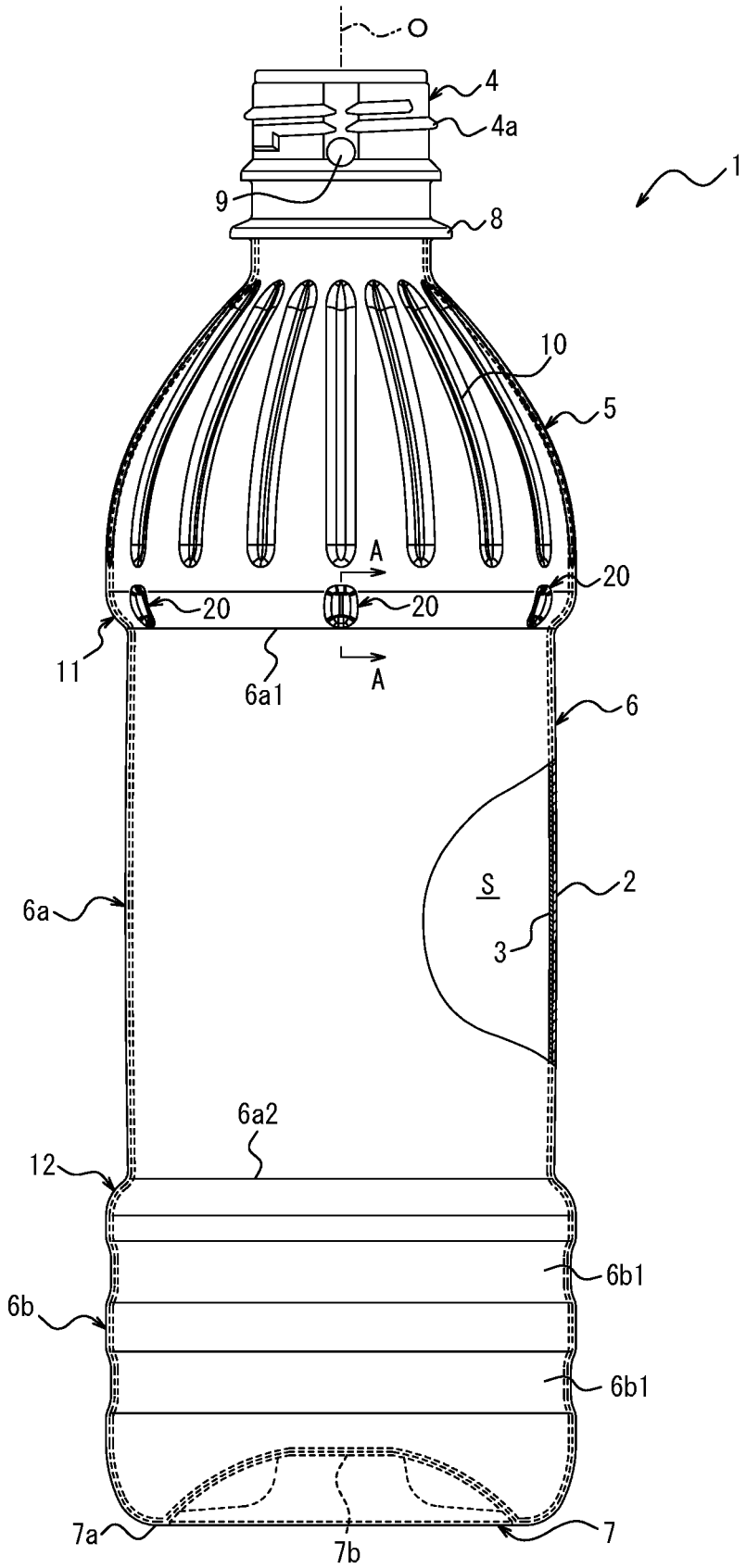
FIG. 1 is a front view illustrating a container with separable laminated layers according to an embodiment of the present disclosure.

In the present specification and claims, a vertical direction refers to an up and down direction (a direction in which an axis O extends) in a state in which the container 1 with separable laminated layers is in an upright position as illustrated in FIG. 1, and a radial direction refers to a direction that passes the axis O of container 1 with separable laminated layers and that is perpendicular to the axis O.

The container 1 with separable laminated layers illustrated in FIG. 1 is a squeeze-type container that can be used, for example, to store various types of contents, including food seasonings such as soy sauce, food such as beverages, cosmetics such as skin lotion, and toiletries such as shampoo, conditioner, or liquid soap. The container 1 with separable laminated layers has a double-layer structure including an outer layer body 2 and an inner layer body 3.

The outer layer body 2 defines an outer shell of the container 1 with separable laminated layers, and it is made of polyethylene terephthalate (PET). It is to be noted that the outer layer body 2 is not limited to a single layer structure. The outer layer body 2 may have a structure made of a plurality of layers using polyethylene terephthalate as the main material, in order to improve its barrier properties or the like.

The inner layer body 3 is also made of polyethylene terephthalate (PET). The inner layer body 3 is formed in a bag shape having a thickness smaller than that of the outer layer body 2. The inner layer body 3 is separably laminated on an inner surface of the outer layer body 2. Separation of the inner layer body 3 from the inner surface of the outer layer body 2 may be any of separation from a bonded state, separation from a quasi-bonded state in the case of laminated resin articles having no compatibility with each other, and separation from a close contact state. Inside the inner layer body 3, there is defined a storage space S that is continuous with an opening of the mouth 4. The contents can be stored in the storage space S. In conjunction with dispensing of the contents from the storage space S to the outside, the inner layer body 3 can undergo volume reduction and shape change so as to reduce its internal volume, while separating from the inner surface of the outer layer body 2. It is to be noted that the inner layer body 3 is also not limited to a single layer structure. The inner layer body 3 may have a structure made of a plurality of layers using polyethylene terephthalate as the main material, in order to improve its barrier properties or the like.

In the present embodiment, the container 1 with separable laminated layers is made of polyethylene terephthalate, with both the outer layer body 2 and the inner layer body 3 being made of biaxially stretchable polyethylene terephthalate. Examples of such polyethylene terephthalate include homo PET or the like. Other types of PET, such as isophthalic acid (IPA) modified PET or CHDM modified PET can also be used. Polyethylene terephthalate constituting the outer layer body 2 and polyethylene terephthalate constituting the inner layer body 3 may have the same composition or different compositions.

By forming the outer layer body 2 and the inner layer body 3 made of polyethylene terephthalate, the container 1 with separable laminated layers can be formed lightweight, strong, and highly transparent.

It is to be noted that the outer layer body 2 and the inner layer body 3 are not necessarily made of polyethylene terephthalate, and they may be made of another synthetic resin material, such as polypropylene (PP) or polyethylene (PE).

The container 1 with separable laminated layers has a bottle shape including the mouth 4, a shoulder 5 that is continuous with a lower end of the mouth 4, a trunk 6 that is continuous with a lower end of the shoulder 5, and a bottom 7 that is continuous with a lower end of the trunk 6.

The mouth 4 has a substantially cylindrical shape centered around the axis O, and a male screw **4*a* is integrally provided on an outer peripheral surface thereof. To the male screw 4*a*, a member, such as a dispensing cap, may be mounted. A neck ring 8 is also provided integrally on the lower side of the male screw 4***a* of the mouth 4.

The outer peripheral surface of the mouth 4 may be configured to include a projection, instead of the male screw 4*a*, so that the mouth 4 can be plugged by a member, such as a dispensing cap, by undercut engagement. Further, the neck ring 8 may also be omitted.

The mouth 4 is provided with an ambient air inlet 9. In the embodiment, the ambient air inlet 9 is provided in part of the outer layer body 2 that constitutes the mouth 4, as a through hole passing through the outer layer body 2 in the radial direction. The ambient air inlet 9 extends between the outer layer body 2 and the inner layer body 3, and as the inner layer body 3 separates from the outer layer body 2, ambient air can be introduced between the outer layer body 2 and the inner layer body 3.

The shoulder 5 has a shape that gradually increases in diameter downward. In the present embodiment, the shoulder 5 has a dome shape that is convex toward the outer side of the container. The shoulder 5 has a substantially circular sectional shape perpendicular to the axis O.

The shoulder 5 is provided with a plurality of concave ribs (18 concave ribs) 10, which are arranged at regular intervals in the circumferential direction (for convenience, only a single concave rib is denoted by a reference numeral in FIG. 1). Each of these concave ribs 10 has a groove shape concave toward the inner side of the container while extending in the vertical direction. By configuring the shoulder 5 with the plurality of concave ribs 10, a passage for ambient air is easily formed from the ambient air inlet 9 provided in the mouth 4 to the trunk 6 between the outer layer body 2 and the inner layer body 3. The inner layer body 3 can therefore easily separate from the outer layer body 2.

Additionally, the shape of the shoulder 5, which gradually increases in diameter downward, may be changed in various ways. Further, the shoulder 5 may be configured without concave ribs 10.

The trunk 6 has a substantially cylindrical shape as a whole, and it includes a squeeze area 6*a* and a reinforced area (trunk's lower area) 6*b*. In the container 1 with separable laminated layers, by squeezing (pressing) the squeeze area 6*a* of the trunk 6 toward the inner side of the container, the contents stored in the storage space S can be pushed and dispensed to the outside through the mouth 4.

The squeeze area 6*a* is provided in a predetermined area of the trunk 6 in the vertical direction that is located near the shoulder 5.

The squeeze area 6*a* has a drum shape (barrel shape) with the maximum diameter portion being located between an upper end 6*a*1 and a lower end 6*a*2. The squeeze area 6*a* has a circular sectional shape perpendicular to the axis O. The squeeze area 6*a* is flexible and can therefore elastically change in shape radially inward (toward the inner side of the container) upon being squeezed (pressed) radially inward. Further, the squeeze area 6*a* is restorable and can therefore be restored to its original shape from a state after shape change, when a squeeze is released. Circumferential ribs are not provided in the squeeze area 6*a*.

In the container 1 with separable laminated layers according to the present embodiment, the squeeze area 6*a* has the drum-shape with the maximum diameter portion being located between the upper end 6*a*1 and the lower end 6*a*2. Accordingly, compared with a case in which the squeeze area 6*a* has a cylindrical shape with a constant outer diameter along the entire area between the upper end 6*a*1 and the lower end 6*a*2, the squeeze area 6*a* can be better restored to the original shape after it has been squeezed and changed in shape radially inward. Consequently, after dispensing of the contents, when a squeeze is released, the squeeze area 6*a* is quickly restored to the original shape, and the squeeze-type container 1 with separable laminated layers can achieve a favorable dispensing operability for dispensing the contents.

Additionally, the squeeze area 6*a* is not limited to the drum shape. The squeeze area 6*a* may be a cylindrical shape having a constant diameter between the upper end 6*a*1 and the lower end 6*a*2, or an hourglass shape with the minimum diameter portion being located between the upper end 6*a*1 and the lower end 6*a*2.

The outer diameter of the upper end 6*a*1 of the squeeze area 6*a* is smaller than the outer diameter of the lower end of the shoulder 5, and a circumferential step portion 11 is provided around the axis O between the upper end 6*a*1 of the squeeze area 6*a* and the lower end of the shoulder 5. That is, the upper end 6*a*1 of the squeeze area 6*a* is continuous with the lower end of the shoulder 5 via the circumferential step portion 11.

In the present embodiment, the step portion 11 has a curved shape that gradually decreases in diameter in a direction from the shoulder 5 toward the squeeze area 6*a* and that is convex toward the outer side of the container. This increases rigidity of the step portion 11, thereby preventing shape change of the step portion 11 following the squeeze area 6*a* being squeezed and changed in shape. Dispensing operability of the squeeze area 6*a* can therefore be increased.

The reinforced area 6*b* has a substantially cylindrical shape having a larger diameter than the squeeze area 6*a*, and two annular ribs 6*b*1 are provided on its outer peripheral surface. The two annular ribs 6*b*1 have a concave groove shape extending in the circumferential direction. With the two annular ribs 6*b*1, the reinforced area 6*b* has a higher rigidity in the radial direction than the squeeze area 6*a*.

The outer diameter of an upper end of the reinforced area 6*b* is larger than the outer diameter of the lower end 6*a*2 of the squeeze area 6*a*. A circumferential secondary step portion 12 is also provided around the axis O between the upper end of the reinforced area 6*b* and the lower end 6*a*2 of the squeeze area 6*a*. That is, the upper end of the reinforced area 6*b* is continuous with the lower end 6*a*2 of the squeeze area 6*a* via the secondary step portion 12.

By providing the trunk 6 with the reinforced area 6*b* that is continuous with the lower end 6*a*2 of the squeeze area 6*a* via the secondary step portion 12, the lower end 6*a*2 of the squeeze area 6*a* is firmly supported by the reinforced area 6*b* via the secondary step portion 12. Accordingly, the dispensing operability of the squeeze area 6*a* can be increased. Further, providing the annular ribs 6*b*1 in the reinforced area 6*b* can prevent spread of initial separation of the inner layer body 3 from the outer layer body 2 that occurs immediately after the container 1 with separable laminated layers has been formed by blow molding.

The bottom 7 includes a ring-shaped ground contacting portion 7*a* extending around the axis O, and a bottom panel 7*b* located on the inner side of the ground contacting portion 7*a*. The bottom 7 closes the lower end of the trunk 6.

The container 1 with separable laminated layers configured as above is a blow molded product.

In a case in which the container 1 with separable laminated layers is a blow molded product, for example, the container 1 with separable laminated layer can be formed by biaxially stretched blow molding a preform having a double-layer structure including an outer body and an inner body. The outer body has been formed by injection molding polyethylene terephthalate. The inner body has been formed independently of the outer body, by injection molding polyethylene terephthalate. In this case, the outer body corresponds to the outer layer body 2, and the inner body corresponds to the inner layer body 3.

It is to be noted that the container 1 with separable laminated layers may also be formed by biaxially stretching blow molding a preform with laminated layers that is configured with laminated synthetic resin materials corresponding to the outer layer body 2 and the inner layer body 3.

Further, the container 1 with separable laminated layers may also be formed by subjecting a cylindrical parison with laminated synthetic resin materials corresponding to the outer layer body 2 and the inner layer body 3 to extrusion blow molding (EBM) in which blow molding is performed using a splittable mold.

Recesses 20 concave toward the inner side of the container are formed in the step portion 11 provided between the shoulder 5 and the squeeze area 6*a* of the trunk 6. In the present embodiment, six recesses 20 are provided in the step portion 11 at intervals in the circumferential direction. Additionally, only three recesses 20 are illustrated in FIG. 1.

Figure 2:
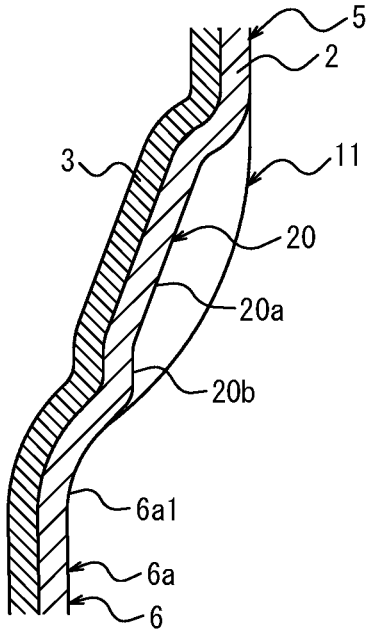
FIG. 2 is a sectional view taken along line A-A in FIG. 1.

As illustrated in FIG. 2, each of these recesses 20 includes a bottom wall 20*a* whose longitudinal section has a flat shape, and a curved peripheral wall 20*b* that surrounds the periphery of the bottom wall 20*a*. Via the curved peripheral wall 20*b*, the bottom wall 20*a* extends continuously to an outer peripheral surface of the step portion 11. Each recess 20 is formed in a longitudinal rib shape extending in a direction from the shoulder 5 toward the trunk 6. Additionally, the peripheral wall 20*b* may be an inclined wall extending from the outer peripheral surface of the step portion 11 toward the bottom wall 20*a*.

Thus, in the container 1 with separable laminated layers according to the present embodiment, the recesses 20 concave toward the inner side of the container are formed in the step portion 11 provided between the shoulder 5 and the squeeze area 6*a* of and the trunk 6. Accordingly, when the contents is dispensed and the inner layer body 3 undergoes volume reduction and shape change relative to the outer layer body 2, the inner layer body 3 collapses from the recesses 20, so that the inner layer body 3 can easily separate from the outer layer body 2 in the step portion 11. Consequently, even when the container 1 with separable laminated layers is configured with the circumferential step portion 11 provided between the shoulder 5 and the squeeze area 6*a* so as to ensure flexibility and restorability of the squeeze area 6*a*, during dispensing of the contents, the inner layer body 3 can easily separate from the outer layer body 2 from the recesses 20 in the step portion 11. The container 1 with separable laminated layers can therefore increase separability of the inner layer body 3 from the outer layer body 2, while ensuring dispensing operability for the contents.

In particular, in a case in which the container 1 with separable laminated layers is a blow molded product in which the outer layer body 2 and the inner layer body 3 are made of polyethylene terephthalate as in the present embodiment, the inner layer body 3 is less likely to separate from the outer layer body 2 in the step portion 11. By providing the recesses 20 in the step portion 11 as in the present embodiment, however, the inner layer body 3 can easily separate from the outer layer body 2 in the step portion 11 even in such a container 1 with separable laminated layers.

Further, in the container 1 with separable laminated layers according to the present embodiment, each recess 20 is formed in a longitudinal rib shape extending in the direction from the shoulder 5 toward the trunk 6. Accordingly, the inner layer body 3 can easily separate from the outer layer body 2 along the entire step portion 11 in the vertical direction. During dispensing of the contents, the inner layer body 3 can therefore more easily separate from the outer layer body 2 from the recesses 20 in the step portion 11.

Further, in the container 1 with separable laminated layers according to the present embodiment, the step portion 11 is provided with a plurality of recesses 20 arranged at intervals in the circumferential direction. Accordingly, the inner layer body 3 can easily separate from the outer layer body 2 at a plurality of positions of the step portion 11 in the circumferential direction. During dispensing of the contents, the inner layer body 3 can therefore more easily separate from the outer layer body 2 in the step portion 11.

As illustrated in FIG. 1, the respective recesses 20 may be configured to be arranged below the concave ribs 10 provided in the shoulder 5 in a manner such that each recess 20 aligns with a corresponding concave rib 10 in the circumferential direction. With this configuration, a passage for ambient air that is formed by the concave ribs 10 from the ambient air inlet 9 provided in the mouth 4 and between the outer layer body 2 and the inner layer body 3 communicates to a space in the trunk 6 between the outer layer body 2 and the inner layer body 3 through portions of the recesses 20 at which the inner layer body 3 has separated from the outer layer body 2. The inner layer body 3 can therefore easily separate from the outer layer body 2 in the trunk 6.

In this case, as illustrated, it is preferable to provide one of the recesses 20 below a concave rib 10 that is located directly below the ambient air inlet 9. By doing so, a passage for ambient air can be formed directly from the ambient air inlet 9 provided in the mouth 4 toward the trunk 6. The inner layer body 3 can therefore more easily separate from the outer layer body 2 in the trunk 6.

Figure 3:
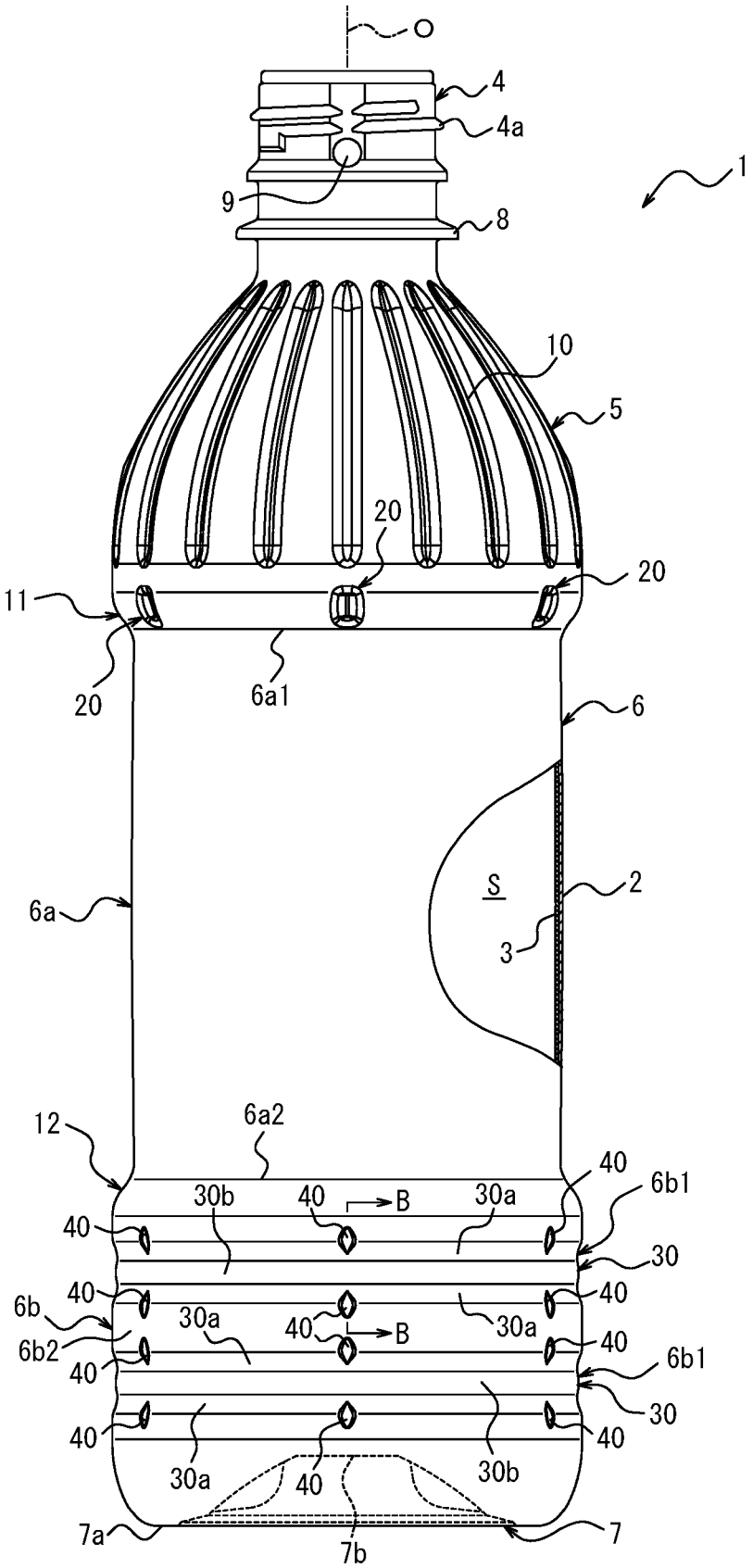
FIG. 3 is a front view illustrating a container with separable laminated layers according to a modification of the present disclosure.
Figure 4:
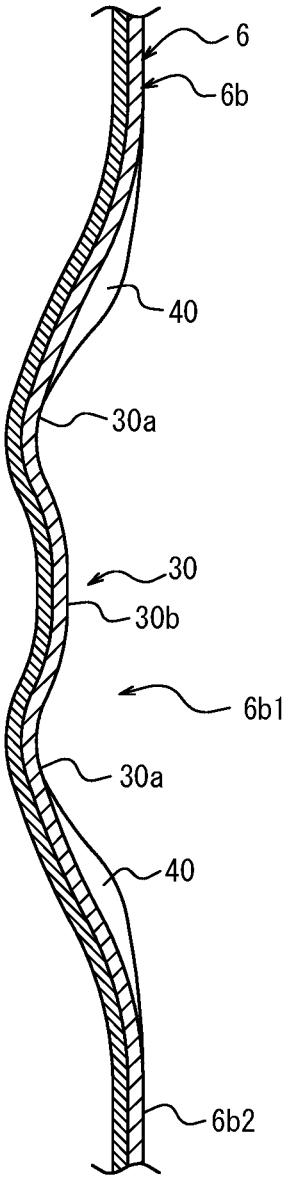
FIG. 4 is a sectional view taken along line B-B in FIG. 3.

FIG. 3 is a front view illustrating a container 1 with separable laminated layers according to a modification of the present disclosure, and FIG. 4 is a sectional view taken along line B-B in FIG. 3. In FIG. 3 and FIG. 4, components corresponding to those described above are denoted by the same reference numerals.

In the squeeze-type container 1 with separable laminated layers, by providing the groove-shaped annular ribs 6*b*1 extending around the axis in the reinforced area 6*b*, rigidity of the reinforced area 6*b* is increased. This increases flexibility and restorability of the squeeze area 6*a*, so that a favorable dispensing operability for the contents in response to a squeeze can be achieved. Besides, in a case in which there is an almost even part in the trunk 6 in the squeeze-type container 1 with separable laminated layers, unexpected initial separation of the inner layer body 3 from the outer layer body 2 may occur in this part immediately after the container 1 with separable laminated layers has been formed by blow molding. When this initial separation occurs, the inner layer body 3 is not able to have a constant internal volume, thus possibly causing the problem of variation in filling capacity. By providing the annular ribs 6*b*1 extending around the axis in the reinforced area 6*b* as described above, it is possible to prevent spread of the initial separation. Nevertheless, in a case in which the reinforced area 6*b* is configured with annular ribs 6*b*1, the inner layer body 3 is also formed in a shape difficult to collapse in part thereof where the annular ribs 6*b*1 are provided. Accordingly, another problem can arise after dispensing of the contents that the inner layer body 3 is less likely to separate from the outer layer body 2 in the part thereof where the annular ribs 6*b*1 are provided.

In view of the above, in the container 1 with separable laminated layers according to the modification illustrated in FIG. 3 and FIG. 4, the reinforced area 6*b* is provided with two peripheral grooves 30, as annular ribs 6*b*1 extending around the axis. Further, pairs of upper and lower secondary recesses 40 concave toward the inner side of the container are provided on each peripheral groove 30 in a manner such that each secondary recess extends over an outer peripheral surface 6*b*2 of the reinforced area 6*b* and the peripheral groove 30.

The two peripheral grooves 30 each include a pair of side wall portions 30*a*, each of which is continuous with the outer peripheral surface 6*b*2 of the reinforced area 6*b* that faces radially outward and each of which is slightly inclined with respect to the outer peripheral surface 6*b*2. The two peripheral grooves 30 each also include a bottom wall portion 30*b* provided between the pair of side wall portions 30*a*. The bottom wall portion 30*b* has a convex shape protruding toward the outer side of the container and extending around the axis O. By thus forming the bottom wall portions 30*b* in a convex shape, rigidity of the peripheral grooves 30 in the radial direction is increased. Buckling strength of the container 1 with separable laminated layers can therefore be increased.

An upper secondary recess 40 in each pair of secondary recesses 40 extends from the outer peripheral surface 6*b*2 of the reinforced area 6*b* over to an upper side wall portion 30*a* of the peripheral groove 30 from the upper side. A lower secondary recess 40 in each pair of secondary recesses 40 extends from the outer peripheral surface 6*b*2 of the reinforced area 6*b* over to a lower side wall portion 30*a* of the peripheral groove 30 from the lower side. The upper secondary recesses 40 and the lower secondary recesses 40 are aligned in the circumferential direction around the axis O. Additionally, only some of the secondary recesses 40 are illustrated in FIG. 3.

In the container 1 with separable laminated layers according to the modification, in the reinforced area 6*b*, pairs of upper and lower secondary recesses 40 concave toward the inner side of the container are provided on each peripheral groove 30 in a manner such that each secondary recess extends over the outer peripheral surface 6*b*2 of the reinforced area 6*b* and the peripheral groove 30. Accordingly, even when the reinforced area 6*b* is configured with peripheral grooves 30, after dispensing of the contents, that is, when the inner layer body 3 undergoes volume reduction and shape change relative to the outer layer body 2 in conjunction with dispensing of the contents, the inner layer body 3 can separate from the outer layer body 2, by undergoing shape change by curving toward the inner side of the container from the pairs of upper and lower secondary recesses 40 in parts thereof where the peripheral grooves 30 are provided. At this time, the outer layer body 2 does not undergo shape change to curve in this way. With the above configuration, the inner layer body 3 can therefore easily separate from the outer layer body 2, by curving toward the inner side of the container after dispensing of the contents.

Thus, the container 1 with separable laminated layers according to the modification is configured with the peripheral grooves 30 provided in the reinforced area 6*b*. In the reinforced area 6*b*, pairs of upper and lower secondary recesses 40 concave toward the inner side of the container are provided on each peripheral groove 30 in a manner such that each secondary recess extends over the outer peripheral surface 6*b*2 of the reinforced area 6*b* and the peripheral groove 30. Accordingly, separability of the inner layer body 3 after dispensing of the contents can be increased, while initial separation of the inner layer body 3 immediately after molding is prevented by the peripheral grooves 30 in the reinforced area 6*b*.

In particular, in a case in which the container 1 with separable laminated layers is a blow molded product in which the outer layer body 2 and the inner layer body 3 are made of polyethylene terephthalate as in the present embodiment, the inner layer body 3 is far less likely to separate from the outer layer body 2 in parts of the reinforced area 6*b* where the peripheral grooves 30 are provided. By providing pairs of upper and lower secondary recesses 40 with the aforementioned configuration in the reinforced area 6*b* as in the modification, after dispensing of the contents, the inner layer body 3 can easily separate from the outer layer body 2 in the parts of the reinforced area 6*b* where the peripheral grooves 30 are provided, even in such a container 1 with separable laminated layers.

Each secondary recess 40 can be formed, for example, in a longitudinal rib shape extending in a direction from the shoulder 5 toward the bottom 7. In the above modification, each secondary recess 40 has a longitudinal rib shape with pointed upper and lower ends. With this configuration, when the contents is dispensed and the inner layer body 3 undergoes volume reduction and shape change relative to the outer layer body 2, the inner layer body 3 can more easily separate from the outer layer body 2, by readily curving toward the inner side of the container from a center-line portion connecting upper and lower ends of each pair of secondary recesses 40 or a portion adjacent thereto.

In the container 1 with separable laminated layers according to the above modification, a plurality of pairs of secondary recesses 40 are provided with respect to each of the two upper and lower peripheral grooves 30 formed in the reinforced area 6*b*. That is, some pairs of upper and lower secondary recesses 40 are provided with respect to the upper peripheral groove 30 so as to extend over the outer peripheral surface 6*b*2 of the reinforced area 6*b* and the upper peripheral groove 30. Other pairs of upper and lower secondary recesses 40 are also provided with respect to the lower peripheral groove 30 so as to extend over the outer peripheral surface 6*b*2 of the reinforced area 6*b* and the lower peripheral groove 30. The pairs of upper and lower secondary recesses 40 provided on the upper peripheral groove 30 and the pairs of secondary recesses 40 provided on the lower peripheral groove 30 are aligned in the circumferential direction around the axis O.

With the above configuration, even in a case in which the reinforced area 6*b* is configured with two upper and lower peripheral grooves 30, when the contents is dispensed and the inner layer body 3 undergoes volume reduction and shape change relative to the outer layer body 2, the inner layer body 3 can curve toward the inner side of the container from the pairs of secondary recesses 40 in the parts thereof where the respective peripheral grooves 30 are provided. It is thus ensured that the inner layer body 3 separates from the outer layer body 2 without any of the peripheral grooves 30 hindering separation.

Additionally, the number of peripheral grooves 30 is not limited to two, and the reinforced area 6*b* may also be configured with a plurality of peripheral grooves 30. In this case, pairs of upper and lower secondary recesses 40 may be only provided with respect to at least one of the plurality of peripheral grooves 30. In a case in which pairs of upper and lower secondary recesses 40 are only provided with respect to at least one of the plurality of peripheral grooves 30, it is preferable to provide pairs of upper and lower secondary recesses 40 only with respect to one of the plurality of peripheral grooves 30 that is closest to the ambient air inlet 9 (which is the uppermost peripheral groove 30 in the present embodiment, since the ambient air inlet 9 is provided in the mouth 4) in order to maintain an introduction passage for ambient air without difficulty.

Further, in the container 1 with separable laminated layers according to the modification, a plurality of pairs (six pairs) of secondary recesses 40 are arranged at intervals in the circumferential direction in the reinforced area 6*b*. More specifically, in the reinforced area 6*b*, a plurality of pairs of upper and lower secondary recesses 40 are provided with respect to the upper peripheral groove 30 at regular intervals in the circumferential direction. A plurality of pairs of upper and lower secondary recesses 40 are also provided with respect to the lower peripheral groove 30 at regular intervals in the circumferential direction. The plurality of pairs of upper and lower secondary recesses 40 provided on the upper peripheral groove 30 and the plurality of pairs of upper and lower secondary recesses 40 provided on the lower peripheral groove 30 are arranged so that corresponding secondary recesses 40 are aligned with each other in the circumferential direction around the axis O.

With the above configuration, in a case in which the reinforced area 6*b* is configured with peripheral grooves 30, when the contents is dispensed and the inner layer body 3 undergoes volume reduction and shape change relative to the outer layer body 2, the inner layer body 3 undergoes shape change as follows. That is, in the parts where the respective peripheral grooves 30 are provided, the inner layer body 3 curves toward the inner side of the container from pairs of upper and lower secondary recesses 40 in some of a plurality of parts of the reinforced area 6*b* in the circumferential direction provided with the secondary recesses 40 that are more susceptible to shape change, depending on squeezing position, variation in molding, or the like. The inner layer body 3 can therefore separate from the outer layer body 2 over a wide area in the circumferential direction.

The secondary recesses 40 are preferably provided so as to align with the recesses 20 provided in the step portion 11 in the circumferential direction. In a case in which a plurality of pairs (six pairs) of secondary recesses 40 are provided at intervals in the circumferential direction in the reinforced area 6*b* as in the above modification, each of these secondary recesses 40 is preferably provided so as to align with a corresponding recess 20 provided in the step portion 11 in the circumferential direction. With this configuration, the inner layer body 3 can easily separate from the outer layer body 2 at identical positions in both the step portion 11 and the reinforced area 6*b* in the circumferential direction. Consequently, a path for ambient air that has been introduced from the shoulder 5 to the trunk 6 is likely to reach the reinforced area 6*b*. During dispensing of the contents, the inner layer body 3 can therefore easily separate from the outer layer body 2 over the entire trunk 6.

The present disclosure is not limited to the above embodiment, and various modifications can be made without departing from the gist of the present disclosure.

For example, although in the above embodiment a plurality of recesses 20 are provided in the step portion 11, the present disclosure is not limited to this example. It is sufficient that at least one recess 20 is provided in the step portion 11.

Although in the above embodiment each recess 20 has a vertical rib shape, the present disclosure is not limited to this example. Each recess 20, which is shaped concave toward the inner side of the container, may have various shapes. Additionally, instead of the recesses 20, convexes protruding toward the outer side of the container may be provided in the step portion 11. In this case, the protruding height of each convex toward the outer side in the radial direction is less than or equal to the maximum diameter of the shoulder 5.

Further, although in the above embodiment the step portion 11 has a curved shape that gradually decreases in diameter in the direction from the shoulder 5 toward the squeeze area 6*a* and that is convex toward the outer side of the container, the present disclosure is not limited to this example. The step portion 11 may have various shapes, such as a curved shape that is convex toward the inner side of the container, or an inclined surface (conical) shape that gradually decreases in diameter in the direction from the shoulder 5 toward the squeeze area 6*a*.

Moreover, the upper end 6*a*1 of the squeeze area 6*a* may be configured to be continuous with the lower end of the shoulder 5 via a circumferential rib portion formed as an annular groove that extends in the circumferential direction and that is concave toward the inner side of the container. The rib portion may be configured with recesses 20. In this case, the rib portion may include a bottom wall, an upper inclined wall, and a lower inclined wall, and it may have a semi-circular or a trapezoidal longitudinal sectional shape. Each recess 20 may be provided only on at least one of the bottom wall, the upper inclined wall, and the lower inclined wall. Alternatively, each recess 20 may be provided to extend over at least two of the bottom wall, the upper inclined wall, and the lower inclined wall. Thus, even in a case in which the container 1 with separable laminated layers is configured with a circumferential rib portion provided between the shoulder 5 and the squeeze area 6*a* so as to ensure flexibility and restorability of the squeeze area 6*a*, during dispensing of the contents, the inner layer body 3 can easily separate from the outer layer body 2 from the recesses 20 in the step portion 11. Thus, the same effect as described above can be obtained In a case in which a reinforced area 6*b* is provided in the trunk 6, the upper end of the reinforced area 6*b* may be configured to be continuous with the lower end 6*a*2 of the squeeze area 6*a* via a circumferential secondary rib portion. In this case, the circumferential secondary rib portion can be formed as an annular groove that extends in the circumferential direction and that is concave toward the inner side of the container.

Moreover, in the above embodiment, the mouth 4, the shoulder 5, and the trunk 6 each have a shape with a circular section perpendicular to the axis O. The present embodiment is, however, not limited to this example, and the section may have other shapes, such as polygonal or elliptical ones.

Moreover, although in the above embodiment the ambient air inlet 9 is provided in part of the outer layer body 2 that constitutes the mouth 4, as a through hole passing through this part in the radial direction, the present disclosure is not limited to this example. The ambient air inlet 9, which is configured to introduce ambient air between the outer layer body 2 and the inner layer body 3, may be provided any of the shoulder 5, the trunk 6, and the bottom 7. The ambient air inlet 9 is not necessarily formed as a through hole and may be a slit-shaped or a gap-like inlet that opens at the boundary between the outer layer body 2 and the inner layer body 3.

Moreover, although each secondary recess 40 has a longitudinal rib shape, the present disclosure is not limited to this example. Each secondary recess 40, which is concave toward the inner side of the container, may have various shapes.

Moreover, the shape and the number of secondary recesses 40 can be changed in various ways.

Moreover, although in the above embodiment the secondary step portion 12 is provided between the squeeze area 6*a* and the reinforced area 6*b*, the step portion 11 may be omitted.

Moreover, the squeeze area 6*a* may be configured with one or more ribs or grooves extending in the vertical direction.

REFERENCE SIGNS LIST

1 Container with separable laminated layers
2 Outer layer body
3 Inner layer body
4 Mouth
4*a* Male screw
5 Shoulder
6 Trunk
6*a* Squeeze area
6*a*1 Upper end
6*a*2 Lower end
6*b* Reinforced area
6*b*1 Annular rib
6*b*2 Outer peripheral surface
7 Bottom
7*a* Grounding portion
7*b* Bottom panel
8 Neck ring
9 Ambient air inlet
10 Concave rib
11 Step portion
12 Secondary step portion
20 Recess
20*a* Bottom wall
20*b* Peripheral wall
30 Peripheral groove
30*a* Side wall portion
30*b* Bottom wall portion
40 Secondary recess
O Axis
S Storage space

The invention claimed is:

1. A container with separable laminated layers comprising an outer layer body, an inner layer body separably laminated on an inner surface of the outer layer body and capable of undergoing volume reduction and shape change, and an ambient air inlet continuously extending between the outer layer body and the inner layer body, wherein the container with separable laminated layers has a bottle shape including a tubular mouth, a shoulder continuous with the mouth, a trunk continuous with the shoulder, and a bottom continuous with the trunk, the trunk includes a squeeze area that is continuous with the shoulder via a circumferential step portion that extends continuously over an entire circumference of the trunk, the step portion is provided with a recess that is concave toward an inner side of the container, the squeeze area has a cylindrical shape, and the shoulder is provided with a concave rib that is concave toward the inner side of the container and that extends in a vertical direction, and the recess is arranged below and spaced from the concave rib so as to align with the concave rib in a circumferential direction.

2. The container with separable laminated layers according to claim 1, wherein the recess is formed in a longitudinal rib shape extending in a direction from the shoulder toward the trunk.

3. The container with separable laminated layers according to claim 1, wherein the step portion is provided with a plurality of the recesses arranged at intervals in a circumferential direction.

4. The container with separable laminated layers according to claim 1, wherein the trunk includes a reinforced area that is continuous with a lower end of the squeeze area via a circumferential secondary step portion or a circumferential secondary rib portion.

5. The container with separable laminated layers according to claim 1, wherein the trunk includes a reinforced area provided below the squeeze area, and the reinforced area is provided with a peripheral groove extending around an axis, and a pair of upper and lower secondary recesses that are concave toward the inner side of the container and that extend over an outer peripheral surface of the reinforced area and the peripheral groove.

6. The container with separable laminated layers according to claim 5, wherein, in the reinforced area, a plurality of the peripheral grooves are provided so as to be arranged at intervals in a vertical direction, and a plurality of the pairs of upper and lower secondary recesses are provided with respect to each of the plurality of peripheral grooves.

7. The container with separable laminated layers according to claim 5, wherein, in the reinforced area, a plurality of the pairs of upper and lower secondary recesses are provided at intervals in a circumferential direction.

8. The container with separable laminated layers according to claim 5, wherein each secondary recess in the pair of upper and lower secondary recesses is formed in a longitudinal rib shape extending in a direction from the shoulder toward the bottom.

9. The container with separable laminated layers according to claim 5, wherein the peripheral groove includes a bottom wall portion with a convex shape protruding toward an outer side of the container and extending around the axis.

10. The container with separable laminated layers according to claim 5, wherein the pair of upper and lower secondary recesses is provided so as to align with the recess in a circumferential direction.

11. The container with separable laminated layers according to claim 1, wherein the outer layer body and the inner layer body are made of polyethylene terephthalate.

12. A container with separable laminated layers comprising an outer layer body, an inner layer body separably laminated on an inner surface of the outer layer body and capable of undergoing volume reduction and shape change, and an ambient air inlet continuously extending between the outer layer body and the inner layer body, wherein the container with separable laminated layers has a bottle shape including a tubular mouth, a shoulder continuous with the mouth, a trunk continuous with the shoulder, and a bottom continuous with the trunk, the trunk includes a squeeze area that is continuous with the shoulder via a circumferential step portion that extends continuously over an entire circumference of the trunk, the step portion is provided with a recess that is concave toward an inner side of the container, the squeeze area has a cylindrical shape, and the step portion has a curved shape that gradually decreases in diameter in a direction from the shoulder toward the squeeze area and that is convex toward an outer side of the container at the curved shape that gradually decreases in diameter in the direction from the shoulder toward the squeeze area.

* * * * *